US006722246B2

(12) United States Patent
Porcella

(10) Patent No.: US 6,722,246 B2
(45) Date of Patent: Apr. 20, 2004

(54) CYLINDER COVER

(75) Inventor: Joseph A. Porcella, Bel Air, MD (US)

(73) Assignee: C.U.E., Inc., Cranberry Township, PA (US)

( * ) Notice: Subject to any disclaimer, the term of this patent is extended or adjusted under 35 U.S.C. 154(b) by 0 days.

(21) Appl. No.: 09/755,466

(22) Filed: Jan. 5, 2001

(65) Prior Publication Data

US 2002/0088328 A1 Jul. 11, 2002

(51) Int. Cl.[7] ..... B26D 7/20
(52) U.S. Cl. ..... 83/659; 83/347; 83/698.42
(58) Field of Search ..... 83/659, 347, 698.42

(56) References Cited

U.S. PATENT DOCUMENTS 3,577,822 A * 5/1971 Sauer et al. ..... 83/659
3,602,970 A * 9/1971 Smith ..... 83/659
3,633,246 A * 1/1972 Kirkpatrick ..... 83/659
3,739,675 A * 6/1973 Duckett et al. ..... 83/659
3,765,329 A * 10/1973 Kirkpatrick et al. ..... 83/659
3,880,037 A * 4/1975 Duckett et al. ..... 83/659
3,882,750 A * 5/1975 Duckett et al. ..... 83/659
3,885,486 A * 5/1975 Kirkpatrick et al. ..... 83/659
4,075,918 A * 2/1978 Sauer ..... 83/659
4,191,076 A * 3/1980 Bollmer et al. ..... 83/659
4,848,204 A * 7/1989 O'Connor et al. ..... 83/659
4,867,024 A * 9/1989 Cho et al. ..... 83/659
5,076,128 A * 12/1991 O'Connor et al. ..... 83/659
5,078,535 A * 1/1992 Kirkpatrick ..... 83/659
5,720,212 A * 2/1998 Kirkpatrick ..... 83/659
5,758,560 A * 6/1998 Fiscus ..... 83/659
5,906,149 A * 5/1999 Montenegro Criado ..... 83/659
5,916,346 A * 6/1999 Neal ..... 83/659
6,116,135 A * 9/2000 Wagner ..... 83/659
6,135,002 A * 10/2000 Neal ..... 83/659
6,435,069 B1 * 8/2002 Kirkpatrick et al. ..... 83/659
6,629,482 B2 * 10/2003 Elia et al. ..... 83/659

* cited by examiner

*Primary Examiner*—Allan N. Shoap
*Assistant Examiner*—Jason Prone
(74) *Attorney, Agent, or Firm*—Webb Ziesenheim Logsdon Orkin & Hanson, P.C.

(57) ABSTRACT

The invention is a cylinder cover engageable with a channel. The cylinder cover includes a flexible blanket with two ends, the ends configured to substantially abut when the blanket is circularly wrapped. Further, the cylinder cover includes a female member attached to the first end of the blanket, the female member having a leg connected with and opposing a resilient engaging element by a base member. The resilient engaging element is configured to frictionally engage a sidewall of the channel. Attached to the second end of the blanket is a substantially rigid male member. When engaged with the channel, the blanket is substantially continually supported by a rigid substrate.

19 Claims, 9 Drawing Sheets

CYLINDER COVER

BACKGROUND OF THE INVENTION

1. Field of the Invention

The present invention relates generally to die cutter blankets and, in particular, to boltless locking arrangements for die cutter blankets.

2. Description of the Prior Art

Rotary die cutting is a process wherein either a continuous web or single sheets of material, e.g., corrugated paper or cardboard, is traversed by way of roller sets or rollers within a differential pressure plenum through the die-cutting machine. Ultimately, this material is passed through a set of rolls, which consists of the die cylinder and the anvil cylinder. A cutting die, which is made up of cutting knives and scoring rule, is mounted on the die cylinder. The anvil cylinder is covered with a removable resilient material, typically referred to as an anvil blanket. The cylinders rotate about parallel axes. As material being processed passes between this set of cylinders, the cutting die penetrates through the material and into the anvil, producing the intended product.

Anvil blankets are flexible covers that wrap around the rotating anvil cylinder. They are typically constructed of a thin sheet metal liner, however, wire, plastic or nylon mesh is also functional. Structural locking members are attached to one or both ends of the liner, and an elastically resilient material, such as urethane, is molded to the outer surface of the assembly. The blankets are built in a variety of sizes; circumference, length, thickness; which complies with the machinery manufacturers' specifications for anvil cylinder construction. Typically, a plurality of blankets is used to cover the length of a standard anvil cylinder.

The anvil cylinder is typically constructed of steel or cast iron. However, the anvil cylinder arrangement may also consist of the basic cylinder surrounded by a series of one-piece or multi-piece slip bearings. The anvil cylinder or slip bearing arrangement is supplied with a channel running parallel to the axis of rotation. This channel is used to attach and mount the anvil blanket to the cylinder. In cooperation with the channel, the blanket is designed with an engaging mechanism to secure the blanket to the cylinder.

An example of a die cutter blanket may be found in U.S. Pat. No. 5,916,346 to Neal, which discloses a typical engagement mechanism for securing the anvil blanket to the anvil cylinder via a channel. The prior art anvil blanket has an engagement mechanism on either edge of the blanket. This engagement mechanism consists of a male member on one edge of the blanket, and a female member on the other edge of the blanket. The male member mates with the female member which, in turn, fits into the channel of the anvil cylinder.

One drawback of the prior art is the structural inadequacies involved with three mating elements. For example, in using the prior art engagement mechanisms, after the female member is inserted into the channel, the normal force used in locking the male member into the female member may cause the female member to become dislodged from the channel. Further, the structure of the prior art engagement mechanisms is such that the cutting die (or knives) are moved along the blanket at a constant pressure. However, when the cutting die reaches the anvil cylinder channel area, the cutting die may not fully cut the material due to the lack of rigidity of the engaged male and female members of the blanket in the channel. One solution to this problem is to increase the pressure of the cutting die, ensuring that it will fully penetrate and cut the material uniformly across the entire perimeter of the anvil cylinder. However, this increased pressure will result in excess cutting and wear of the blanket, resulting in increased maintenance costs and downtime.

SUMMARY OF THE INVENTION

It is therefore an object of the present invention to provide a cylinder cover that overcomes the deficiencies in the prior art. It is another object of the present invention to provide substantially continuous rigid support around the perimeter of the anvil cylinder, particularly across the channel. It is a still further object of the present invention to provide an easily engageable and disengageable engagement mechanism that provides secure attachment of the blanket to the anvil cylinder. It is yet another object of the present invention to provide an engagement mechanism for a die cutter blanket that is simple in its installation and maintenance in the field.

Accordingly, I have invented a cylinder cover which is particularly useful as a die cutter blanket. This cylinder cover includes an engagement mechanism, which interacts with a channel having two opposing sides and a base. The cylinder cover includes a flexible blanket with two ends, with each end configured to abut when the blanket is circularly wrapped around a cylinder, e.g., an anvil cylinder. The present invention also includes a female member attached to one end of the blanket; the female member having a leg connected with and opposing a resilient engaging element by a base member. This resilient engaging element is configured to frictionally engage a side of the channel. Also included in the present invention, is a substantially rigid male member attached to the other end of the blanket.

In a first embodiment, the cylinder cover includes a flexible sheet metal liner having an outer side and an inner side, the flexible sheet metal liner outer side is integrally formed with an inner side of the urethane material. In addition, the female member includes an indentation and the male member includes a projection, such that, in use, the indentation and projection penetrate one another and are frictionally engaged. The female member indentation is attached to the outer surface of the flexible sheet metal liner, and the inner surface of the female member leg is attached to the inner surface of the flexible sheet metal liner. In a second embodiment, the engagement mechanism of the cylinder cover is adapted to engage a slip bearing sleeve, covering an outside surface of an anvil roller, the slip bearing sleeve having a channel with two opposing sides and a base. This embodiment also includes a channel insert within the channel and a male member indentation configured to accept and compress the resilient engaging element against the side of the channel insert. In this second embodiment, the resilient engaging element is a loop structure. It is this loop structure that the male member indentation is configured to compress against the side of the channel insert.

In operation, the female member is inserted into the channel and engaged therein. Next, the blanket is wrapped around the cylinder and the male member inserted into the female member, locking the blanket around the cylinder. When the male and female members are engaged with the channel, the blanket is substantially continually supported by a rigid substrate; the anvil cylinder and the male member.

While the present invention may be utilized with any cylinder having an appropriately sized channel, the cylinder cover of the present invention is particularly suited for use with an anvil roller. Further, the anvil roller may be surrounded by a slip bearing sleeve, the slip bearing sleeve fully covering the anvil roller. This slip bearing sleeve can have a channel, similar to the anvil roller, wherein the female and male members may be engaged. In addition, the channel on the slip bearing sleeve may also have a channel insert which is configured to frictionally receive and contact the female member of the blanket.

The present invention, both as to its construction and its method of operation, together with additional objects and advantages thereof, will best be understood from the following description of specific embodiments when read in connection with accompanying drawings.

DETAILED DESCRIPTION OF THE PREFERRED EMBODIMENTS

Figure 1:
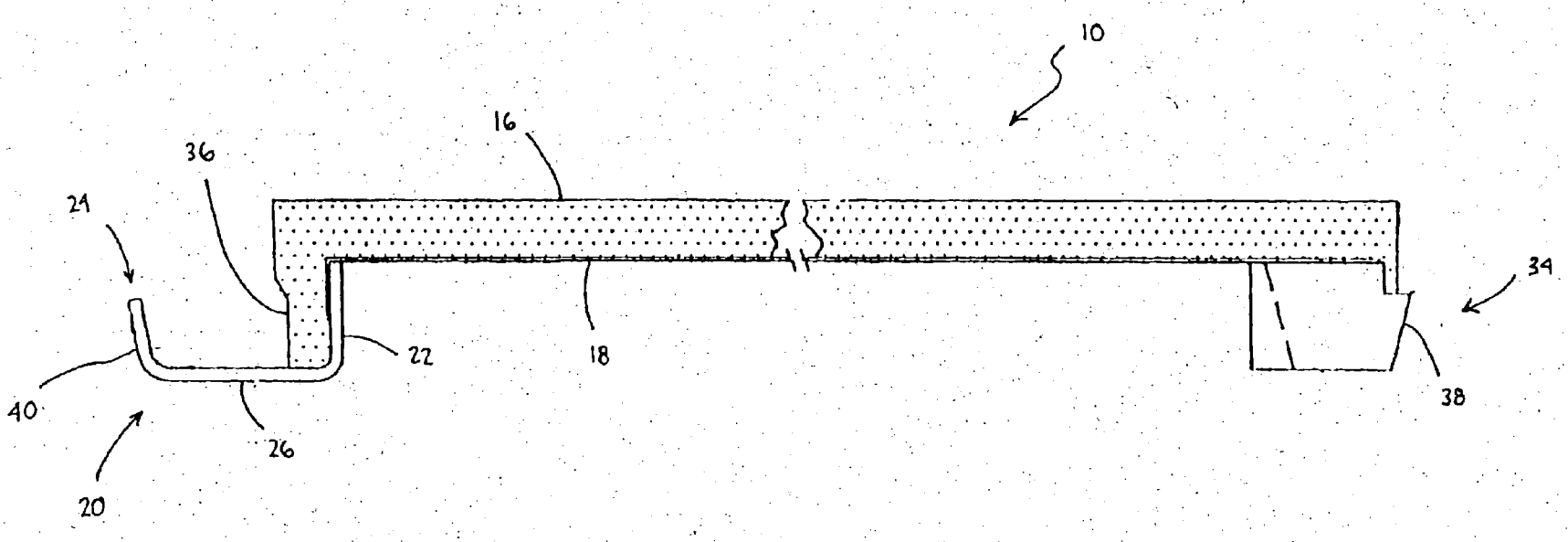
FIG. 1 is a side view of a first embodiment of a cylinder cover according to the present invention.
Figure 2:
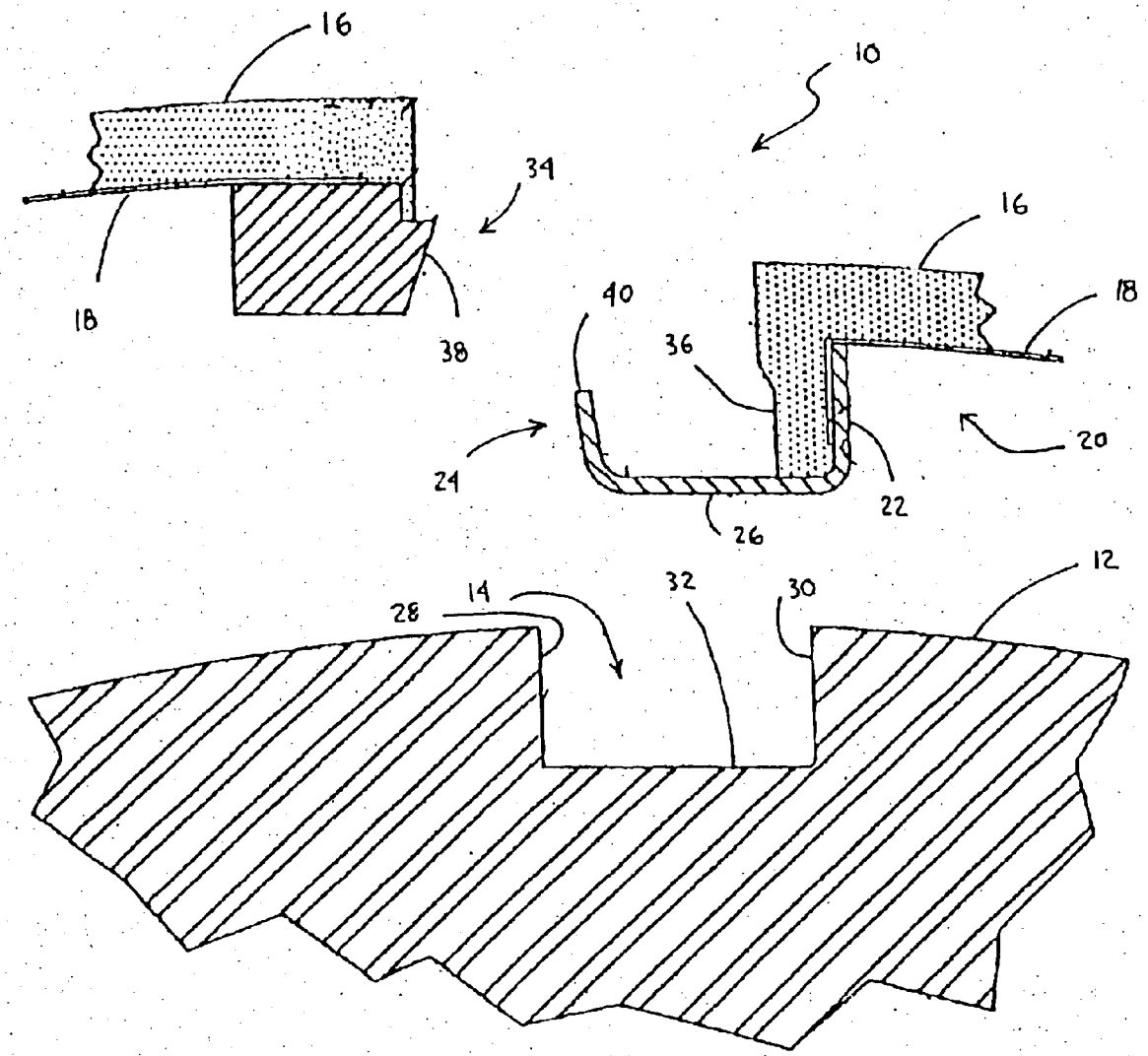
FIG. 2 is an exploded side sectional view of a male end of the present invention, a female end of the present invention and a cylinder with a channel.
Figure 3:
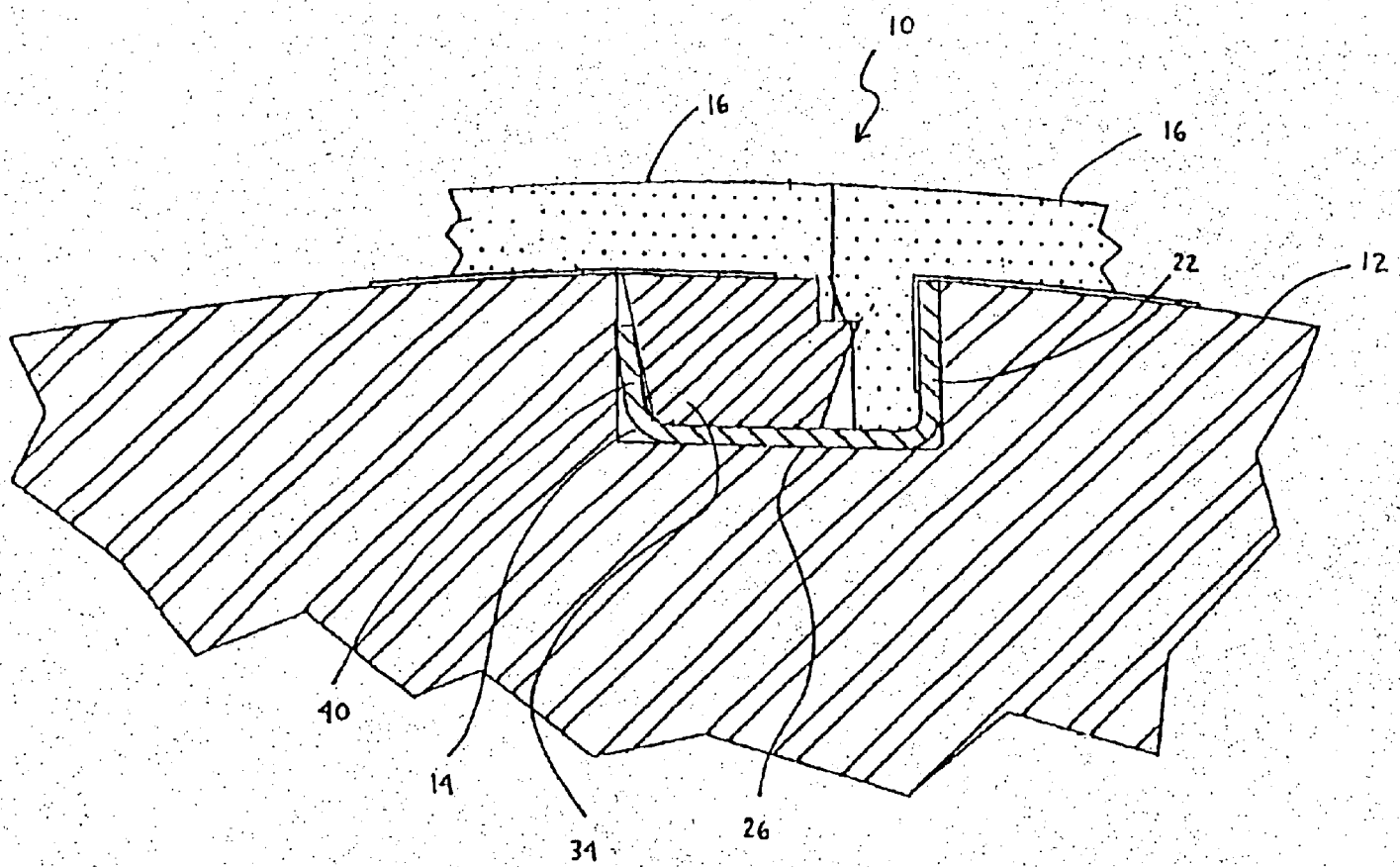
FIG. 3 is the male end and female end of FIG. 2 engaged together and engaged with the channel on the cylinder.
Figure 4:
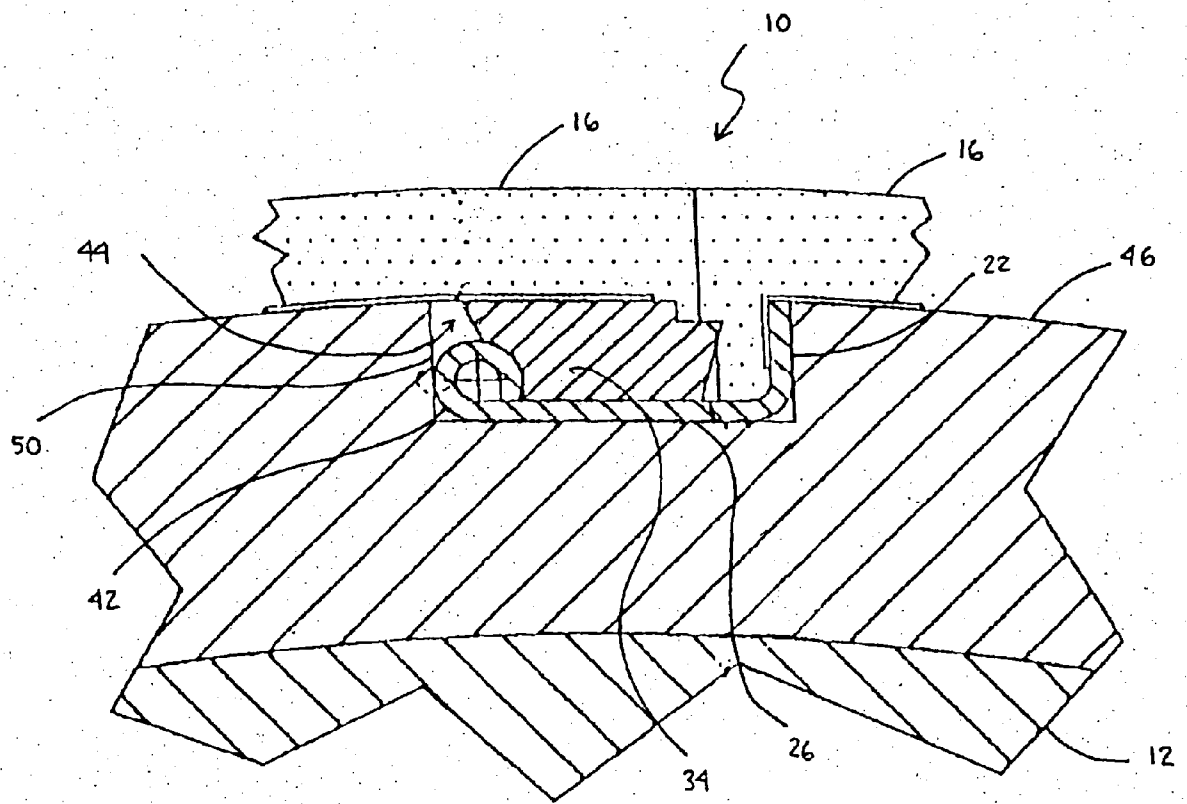
FIG. 4 is a male end and a female end of a second embodiment engaged within a channel on a cylinder.
Figure 5:
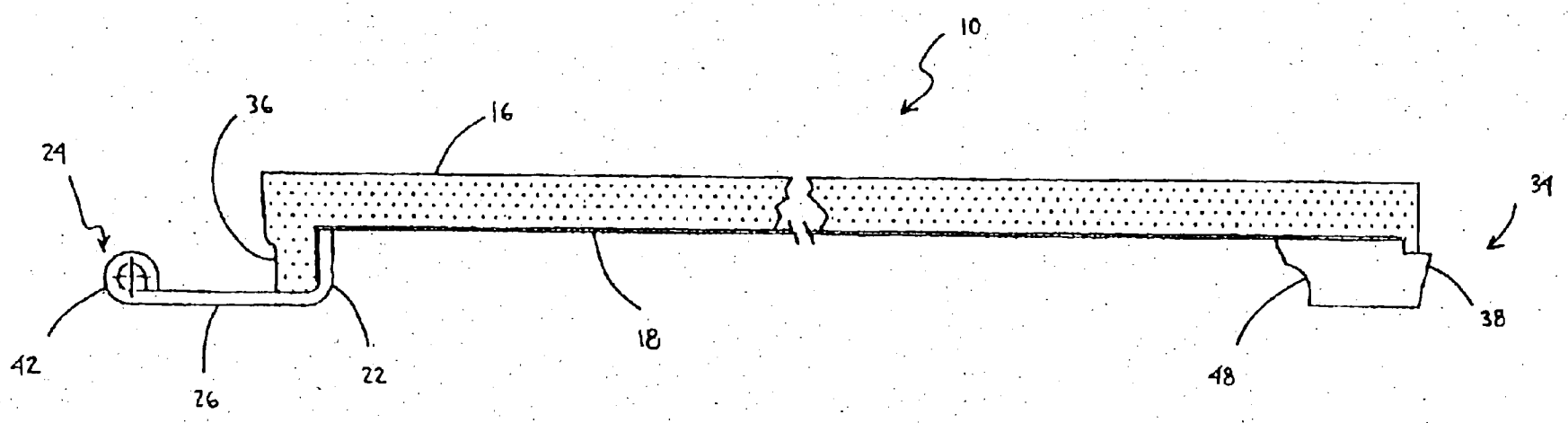
FIG. 5 is a side view of the second embodiment of FIG. 4 according to the present invention.

The first embodiment of the cylinder cover 10 of the present invention is generally shown in FIGS. 1–3. The present invention is for use in applications requiring a cylinder 12 with a channel 14 to be wrapped or covered with a flexible cover, i.e., a blanket 16, to serve as the resilient surface for cutting. The present invention 10 includes a flexible blanket 16 which is wrapped around and secured to the cylinder 12, typically an anvil cylinder 12. The blanket 16 is constructed from a tough, pliable, resilient material such as urethane. When the blanket 16 is wrapped around the anvil cylinder 12, the ends or edges of the blanket 16 are configured to abut, creating a continuous protective covering around the cylinder 12. In order to maintain the physical characteristics of the blanket 16, an inner or underside of the blanket 16 may be lined with a liner, preferably a flexible sheet metal liner 18, the ends of the flexible sheet metal liner 18 permanently attached to the blanket 16. The sheet metal liner 18 may be integral or integrally formed with the blanket 16. It is also envisioned that the sheet metal liner 18 may be formed from other materials, such as a high strength mesh or polymer sheet.

As best seen in FIG. 2, a female member 20 is attached to or integrally formed with one end of the blanket 16. This female member 20 includes a leg 22, typically vertical, connected with and opposing a resilient engaging element 24 via a base member 26. This resilient engaging element 24, in use, frictionally engages a side 28 of the channel 14, locking the female member 20 into the channel 14. The channel 14 is parallel to the axis of the rotation of the cylinder 12 and extends into and out of the plane of the drawings. Further, opposing sides 28 and 30 of the channel 14 are typically parallel, and a base 32 of the channel 14 is typically flat. However, any suitable channel 14 dimensions and configuration is envisioned. The machinery manufacturer dictates the dimension of the assembly. The length of an anvil cylinder 12, as well as the circumference of the anvil cylinder 12 and the die-cutting machine are categorized into standard sizes. For example, the blanket 16 width is typically in the range of 10–20 inches, for ease of handling. Since the blanket 16 is designed to wear, the thickness of the penetrable layer is sized to be thicker than the optimum size. During the die-cutting process, the blanket 16 will wear down to the optimum size and to a degree below to extend the useable life of the blanket 16.

A substantially rigid male member 34 is attached to the second end of the blanket 16. This male member 34 may be a steel bar or any other rigid material that provides an appropriately rigid substrate beneath the blanket 16. This male member 34 is inserted into the female member 20, after the female member 20 has been inserted into the channel. As shown in FIG. 3, in this manner, the blanket 16 is secured end-to-end, as well as secured to the anvil cylinder 12 via the channel 14. Once the male member 34 and female member 20 are engaged with the channel 14, the blanket 16 is substantially continually supported by a rigid substrate. This allows the blades of the die cutter to maintain a constant cutting depth over the entire perimeter of the cylinder 12, including the channel 14 section. This, in turn, allows for consistent cutting and increased production.

In order to better secure the male member 34 with the female member 20, the female member 20 may also include either an indentation 36 or a projection (not shown), and the male member 34 may also include an indentation (not shown) or a projection 38. When the female member 20 includes an indentation 36, the male member 34 will typically include a projection 38, and vice versa. In use, the indentation 36 and the projection 38 penetrate one another and are frictionally engaged. As seen in FIG. 2, the male member 34 has a projection 38, and the female member 20 has an indentation 36, allowing the male member projection 38 to frictionally engage the female member indentation 36. This further secures the male member 34 to the female member 20, holding the blanket 16 around the cylinder 12. In the present embodiment, the female member indentation 36 is formed on a female end of the blanket 16 using the same resilient material as the blanket 16. This female member indentation 36 is attached to an outer surface of the flexible sheet metal liner 18 which is, in turn, attached to an inner surface of the female member leg 22. Since the male member projection 38 is rigid, the rigidity of the overall substrate is not compromised.

It is envisioned that the blanket 16 overlaps an upper edge of the male member 34, as seen in FIG. 2, creating a supplementary mechanical anchor to assist the assembly integrity when wrapping the blanket 16 around the cylinder 12 and in the die cutting operation.

The resilient engaging element 24 may be a tab or lip 40, as shown in FIG. 2, or, in a second embodiment, a loop structure 42, as shown in FIGS. 4–9. One aspect of the engaging element 24 is its resilience and ability to frictionally engage a sidewall 28 of the channel 14, securing the female member 20 to the channel 14. This engaging element 24, when formed as a loop structure 42, may have a substantially circular cross section. In addition, it is envisioned that the engaging element 42 may also have a trilateral, quadrilateral, etc. cross section, as long as it frictionally engages at least one sidewall 28 of the channel 14.

The female member leg 22 may be substantially rigid and is attached to an end of the thin metal liner 18, extending nearly the entire width of the metal liner 18 into and out of the plane of the drawing. The female member leg 22 is attached to the engaging element 24 via a base member 26. Multiple engaging elements 24 may be spaced intermittently or continuously along the length of the female member 20.

While the present invention may be used directly with an anvil roller channel 14 on an anvil roller 12, it may also be used in a channel 44 on a slip bearing sleeve 46, which is covering an outside surface of the anvil roller 12. In essence, the channel 44 of the slip bearing sleeve 46 is utilized identically to the above-discussed channel 14 of the anvil roller 12 or cylinder.

Figure 8:
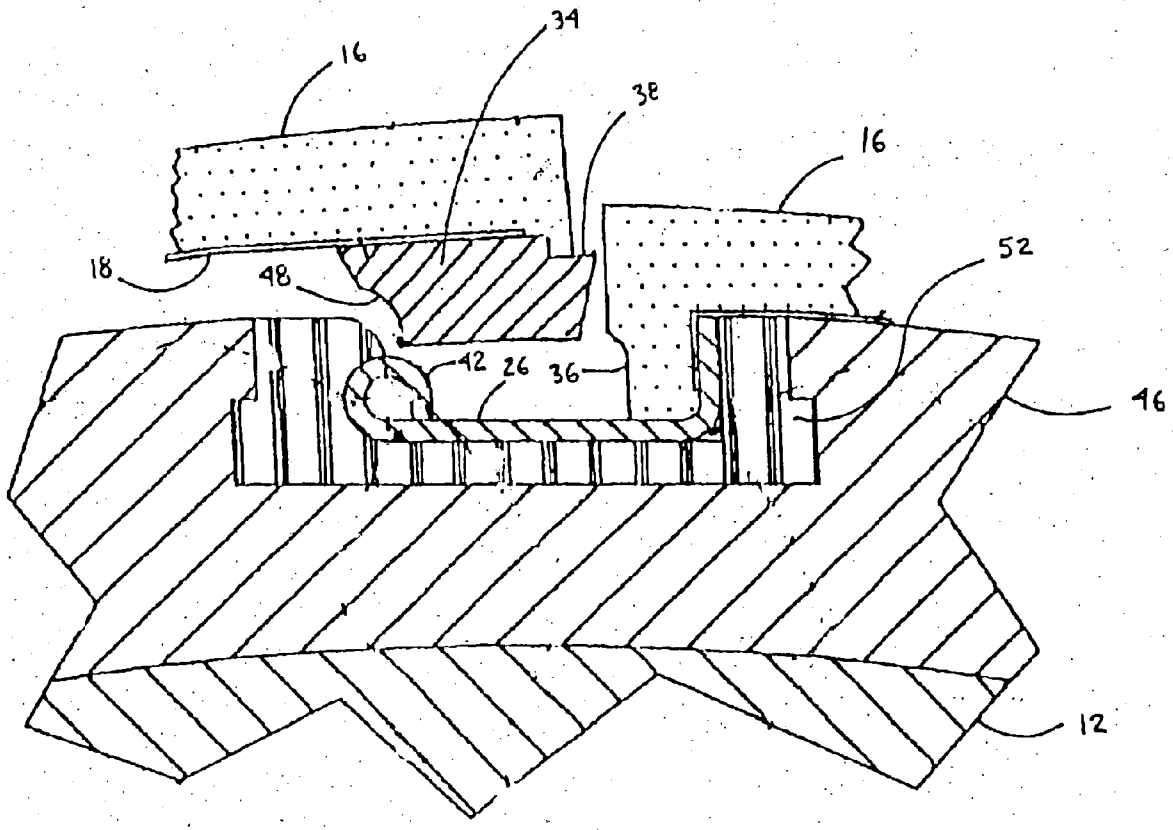
FIG. 8 is an exploded side sectional view of the male member of FIG. 6 being inserted into the female member of FIG. 6.

As best seen in FIG. 8, in the second embodiment of the present invention, the rigid male member 34 includes a male member indentation 48. The male member indentation 48 is configured to accept and abut the engaging element 24. For example, in the second embodiment when the engaging element 24 is a loop structure 42 with a circular cross section, the male member indentation 48 is formed such that it accepts and abuts this circular loop 42. In this manner, the engaging element 24 is further prevented from moving away from and disengaging the sidewall 28 of the channel 14 (FIG. 3) or a sidewall 50 of the slip bearing sleeve 46. This improves the securement of the blanket to the channel 14 or 50 of the slip bearing sleeve 46 or the anvil roller 12, both during installation and use.

It is also envisioned that the male member 34 and male member indentation 48 are formed such that the male member indentation 48 accepts and compresses the resilient engaging element 34 against the side of the channel 14 or 50. This further enhances the female member 20 channel sidewall 14 or 50 engagement, as well as the female member 20 male member 34 engagement.

Figure 6:
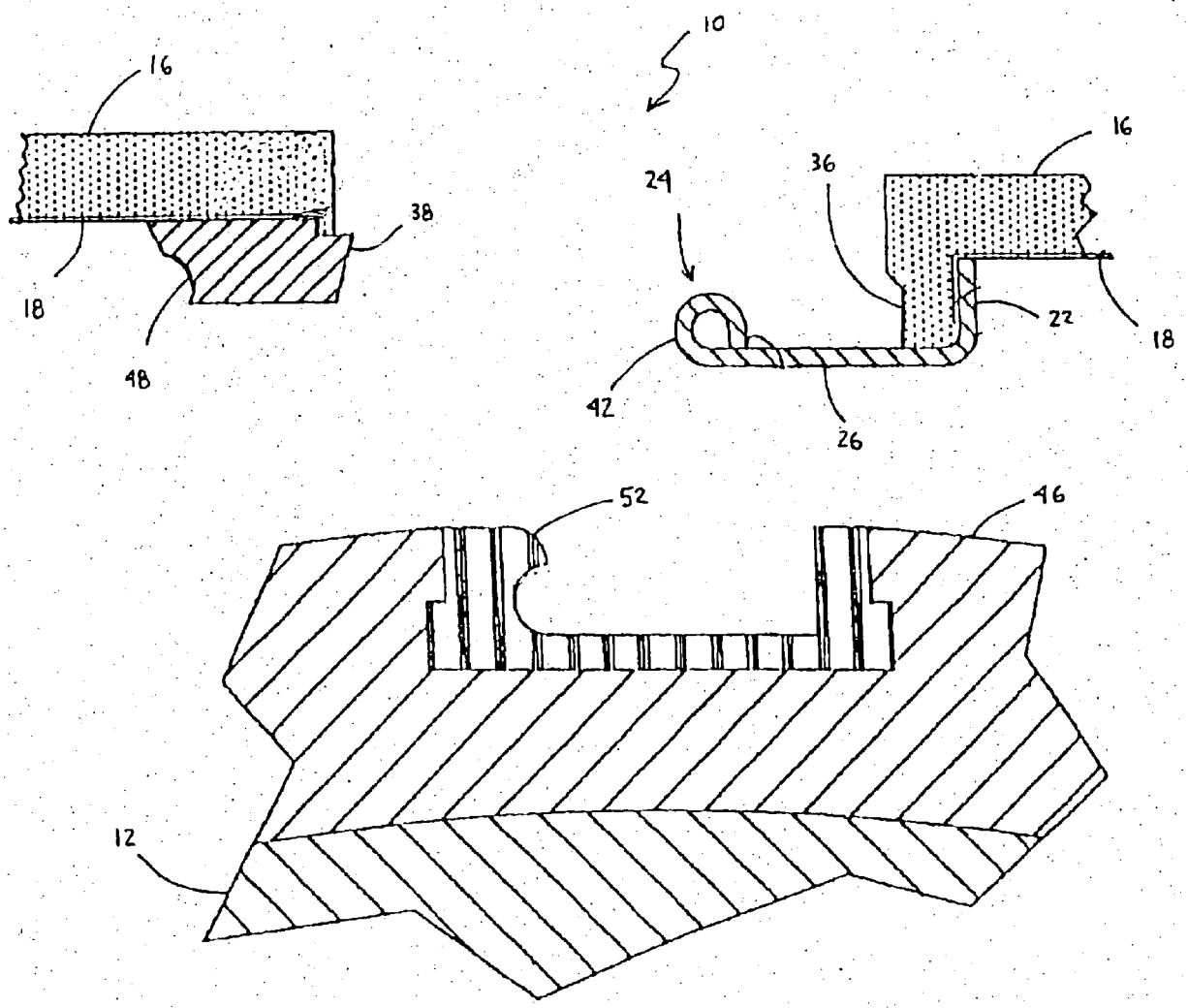
FIG. 6 is an exploded side sectional view of the male member and female member of FIG. 5 and a cylinder having a channel with a channel insert.

The slip bearing sleeve 46 may also include a channel insert 52 within the channel 44. As seen in FIG. 6, the channel insert 52 is either frictionally engaged or directly attached within the slip bearing sleeve channel 44. Further, this channel insert 52 is configured to frictionally receive the female member leg 22, base 26 and engaging element 24.

When using the aforementioned channel insert 52 within the slip bearing sleeve channel 44, the engaging element 24, base 26 and leg 22 of the female member 20 are all formed to abut an inner surface of the channel insert 52 at substantially all points. Next, the male member 34 is inserted into the female member 20, virtually filling the remaining void with the rigid male member 34. As discussed previously, due to the rigidity of the male member 34, a substantially continuous and rigid substrate is formed, yielding improved die cutting benefits. The engaging element 24 is precise in size to fit the configuration of a commercial slip bearing anvil system; engaging the channel insert 52 in conjunction with the female member leg 22. In addition, the dimensions of the engaging element 24 are such as to provide an interference fit with the inner surface of the channel insert 52. The channel insert 52 may be constructed from a rigid material.

Figure 7:
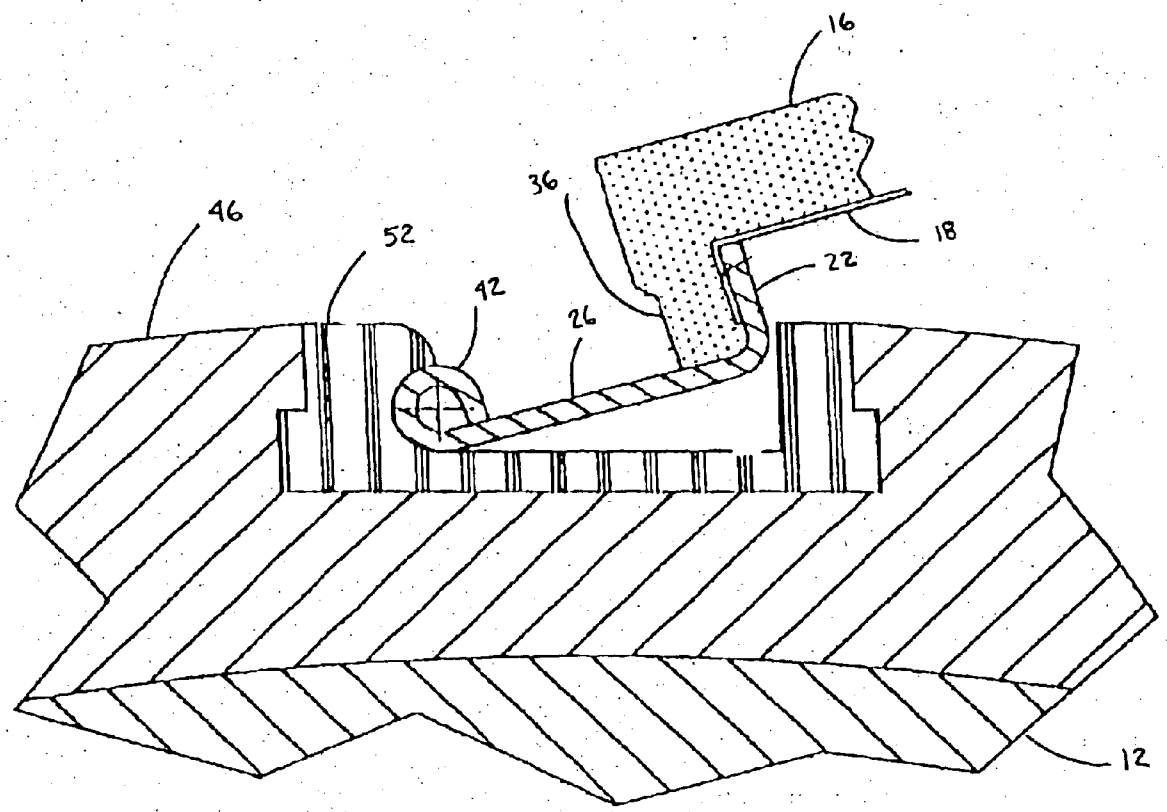
FIG. 7 is an exploded side sectional view of the female member of FIG. 6 being inserted into the channel insert.

In installing the second embodiment, the blanket 16 is assembled and attached to the slip bearing sleeve covering 46. This is initiated by inserting the female member 20 into the channel insert 52 (FIG. 7). The dimension between the female member leg 22 and the outer most distant point on the engaging element 24 is slightly larger than the corresponding inside width of the channel insert 52. This dimensional difference creates an interference fit, as the female member 20 is inserted into the channel insert 52. The engaging element 24 design provides some degree of resilience, creating a significant friction force against the corresponding surfaces of the channel insert 52, i.e., the channel insert 52 radius and the channel insert 52 inside wall. Additionally, the engaging element 24 configuration provides surface contact within the radius of the channel insert 52, reducing the unit loading.

Figure 9:
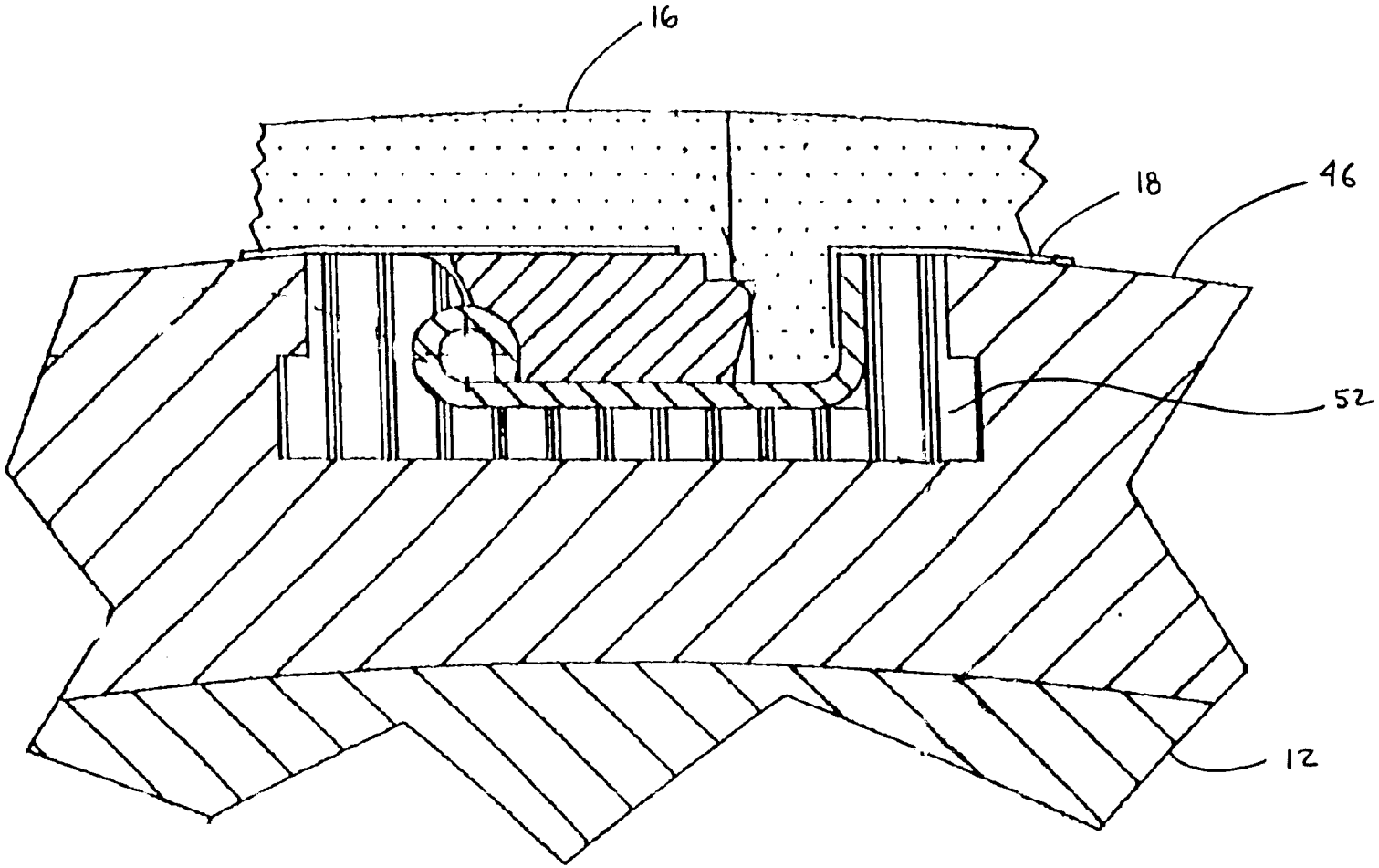
FIG. 9 is the male member and female member of FIG. 6 fully engaged with the channel insert.

Next, the male member 34 is engaged with the female member 20, as shown in FIG. 8. The male member projection 38 is forcibly inserted into the female member indentation 36, while, at the same time, the male member indentation 48 is forcibly inserted adjacent the engaging element 24. When fully inserted, as shown in FIG. 9, the male member projection 38 has penetrated into the female member indentation 36, compressing the material. Also, the male member indentation 48 has elastically deformed the engaging element 24 to securely complete the interlock. This interlock is self-contained within the female member 20. However, as discussed previously, the male member indentation 48 may be formed to not only abut and hold the engaging element 24, but instead to abut and compress the engaging element 24 further.

Overall, the present invention provides a cylinder cover 10 with improved engagement characteristics. In addition, the present invention provides a substantially continuous rigid substrate below the blanket, increasing cutting uniformity. Also, the present invention is both economic and efficient in installation and maintenance.

This invention has been described with reference to the preferred embodiments. Obvious modifications and alterations will occur to others upon reading and understanding the preceding detailed description. It is intended that the invention be construed as including all such modifications and alterations.

I claim:

1. A cylinder cover engageable with a rectangular channel having a top and two opposing straight sides which intersect with a base, comprising:

a flexible blanket having two ends, the ends configured to substantially abut when the blanket is circularly wrapped;

a female member attached to the first end of the blanket, the female member having a leg with an opposing resilient engaging element, wherein the leg and resilient engaging element are made of a single material and are configured to frictionally and resiliently engage the channel against the two opposing straight sides of the channel; and wherein the female member is insertable within the channel from the top and occupies a portion of the channel and a male member attached to the second end of the blanket, wherein the male member is comprised of a rigid metal projection which substantially occupies the remaining portion of the channel, wherein the width of the male member directly adjacent to the flexible blanket is greater than the width of the female member directly adjacent to the flexible blanket; and wherein, the flexible blanket material extends into the channel adjacent to the female member such that when engaged with the channel, the male member is compressed between the blanket material and the channel wall and the blanket is substantially continually supported by a rigid structure.

2. The cylinder cover of claim 1, further comprising a male member indentation configured to accept and abut the resilient engaging element.

3. The cylinder cover of claim 1, further comprising a male member indentation configured to accept and compress the resilient engaging element against a side of the channel.

4. The cylinder cover of claim 1, wherein the opposing sides of the channel are parallel.

5. The cylinder cover of claim 1, wherein the base of the channel is flat.

6. The cylinder cover of claim 1, wherein the female member leg is substantially vertical.

7. The cylinder cover of claim 1, wherein the female member further comprises one of an indentation and a projection and wherein the male member further comprises the other of the indentation and the projection, such that, in use, the indentation and the projection are frictionally engaged.

8. The cylinder cover of claim 1, wherein the female member leg is substantially rigid.

9. The cylinder cover of claim 1, wherein the channel is an anvil roller channel on an anvil roller.

10. The cylinder cover of claim 1, wherein the channel is on a slip bearing sleeve, the slip bearing sleeve covering an outside surface of an anvil roller.

11. The cylinder cover of claim 1, wherein the male member has a projection which engages a female member resilient indentation and wherein the male member further has a male member indentation which engages a loop structure on the female member, such that the male member and female member are frictionally and resiliently engaged within the channel.

12. The cylinder cover of claim 1, further comprising a flexible sheet metal liner having an outer side and an inner side, the flexible sheet metal liner outer side is adjacent to an inner side of the blanket.

13. The cylinder cover of claim 12, wherein the female member further comprises one of an indentation and a projection on the first end of the blanket attached to the outer surface of the flexible sheet metal liner and the inner surface of the leg is attached to the inner surface of the flexible sheet metal liner.

14. The cylinder cover of claim 12, wherein the sheet metal liner is integral with the blanket.

15. The cylinder cover of claim 1, wherein the engaging element is a loop structure.

16. The cylinder cover of claim 15, wherein the engaging element has a substantially circular cross section.

17. The cylinder cover of claim 15, wherein the cross section of the engaging element is one of a trilateral and a quadrilateral.

18. A cylinder cover for use on an anvil roller having a slip bearing sleeve which covers an outside surface of the anvil roller, wherein the slip bearing sleeve has a channel with a top, two opposing sides and a base and wherein there is a channel insert within the channel, the cylinder cover comprising:

a flexible blanket having two ends, the ends configured to substantially abut when the blanket is circularly wrapped;

a female member attached to the first end of the blanket, the female member having a leg with an opposing resilient engaging element, wherein the leg and engaging element are made of a single material and are configured to resiliently and frictionally engage the channel insert; and wherein the female member is insertable within the channel from the top and occupies a portion of the channel inset; and a male member attached to the second end of the blanket, wherein the male member is comprised of a rigid projection which substantially occupies the remaining portion of the channel;

a male member indentation configured to accept and compress the resilient engaging element against a side of the channel insert;

a flexible sheet metal liner having an outer side and an inner side, the flexible sheet metal liner outer side attached to an inner side of the blanket; and wherein the female member further comprises one of an indentation and a projection and wherein the male member further comprises the other of the indentation and the projection, such that, in use, the indentation and projection are frictionally engaged, wherein the female member further comprises one of an indentation and a projection on the first end of the blanket attached to the outer surface of the flexible sheet metal liner and the inner surface of the leg is attached to the inner surface of the flexible sheet metal liner, and wherein, when engaged with the channel, the blanket is substantially continually supported by a rigid substrate.

19. The cylinder cover of claim 8, wherein the channel insert frictionally receives the female member leg, base and engaging element.

* * * * *

UNITED STATES PATENT AND TRADEMARK OFFICE

CERTIFICATE OF CORRECTION

PATENT NO. : 6,722,246 B2
DATED : April 20, 2004
INVENTOR(S) : Porcella

It is certified that error appears in the above-identified patent and that said Letters Patent is hereby corrected as shown below:

Column 8,
Line 48, "cover of claim 8" should read -- cover of claim 18 --

Signed and Sealed this

Fourteenth Day of September, 2004

JON W. DUDAS
*Director of the United States Patent and Trademark Office*